US007824769B2

(12) United States Patent
Nakatsuka et al.

(10) Patent No.: US 7,824,769 B2
(45) Date of Patent: Nov. 2, 2010

(54) CONDUCTIVE SHEATH-CORE CONJUGATE FIBER AND PROCESS FOR PRODUCING THE SAME

(75) Inventors: Hitoshi Nakatsuka, Osaka (JP); Tadayoshi Koizumi, Kurashiki (JP); Kazuhiko Tanaka, Osaka (JP); Nobuhiro Koga, Kurashiki (JP); Masao Kawamoto, Kurashiki (JP); Kenichi Yoshioka, Saijo (JP)

(73) Assignee: Kuraray Co., Ltd., Kurashiki-shi (JP)

( * ) Notice: Subject to any disclaimer, the term of this patent is extended or adjusted under 35 U.S.C. 154(b) by 54 days.

(21) Appl. No.: 12/307,147

(22) PCT Filed: Jun. 21, 2007

(86) PCT No.: PCT/JP2007/062507
§ 371 (c)(1),
(2), (4) Date: Dec. 31, 2008

(87) PCT Pub. No.: WO2008/004448
PCT Pub. Date: Jan. 10, 2008

(65) Prior Publication Data

US 2009/0318049 A1 Dec. 24, 2009

(30) Foreign Application Priority Data

Jul. 3, 2006 (JP) ..... 2006-183104
Sep. 4, 2006 (JP) ..... 2006-238732

(51) Int. Cl.
*D02G 3/00* (2006.01)

(52) U.S. Cl. ..... 428/373; 428/374; 428/370; 442/200; 264/105; 264/130; 264/210.8; 264/211.12; 264/211.14

(58) Field of Classification Search ..... 428/365, 428/370, 373, 374; 442/200; 264/105, 130, 264/172.13, 21.8, 211.12, 211.14, 211.17
See application file for complete search history.

(56) References Cited

U.S. PATENT DOCUMENTS 5,464,695 A * 11/1995 Kawamoto et al. ..... 428/370
6,413,634 B1 * 7/2002 Tanaka et al. ..... 428/370
6,455,156 B1 * 9/2002 Tanaka et al. ..... 428/398
6,811,874 B2 * 11/2004 Tanaka et al. ..... 428/370
2009/0318049 A1 * 12/2009 Nakatsuka et al. ..... 442/200

FOREIGN PATENT DOCUMENTS

| | | |
|---|---|---|
| JP | 57 29611 | 2/1982 |
| JP | 58 132119 | 8/1983 |
| JP | 63 85114 | 4/1988 |
| JP | 10 1824 | 1/1998 |
| JP | 2004 277957 | 10/2004 |
| JP | 2005 256231 | 9/2005 |

OTHER PUBLICATIONS

U.S. Appl. No. 12/090,921, filed Apr. 21, 2008, Nakatsuka, et al.
U.S. Appl. No. 12/282,411, filed Sep. 10, 2008, Koizumi, et al.

* cited by examiner

*Primary Examiner*—N. Edwards
(74) *Attorney, Agent, or Firm*—Oblon, Spivak, McClelland, Maier & Neustadt, L.L.P.

(57) ABSTRACT

In an electrically conductive sheath-core conjugate fiber including an electrically conductive layer made of a thermoplastic polymer (A) containing electrically conductive carbon black fine particles which constitutes a sheath component and a protective layer made of a fiber-forming thermoplastic polymer (B) which constitutes a core component, the ratio of the (A) to the total weight of the (A) and the (B) is 10 to 35% by weight, the $L_1/L_0$ ratio is 1.04 to 10.0 where $L_1$ represents the length of a boundary between the core component and the sheath component in a cross section of the conjugate fiber and $L_0$ represents the length of the circumference of a circle having an area equal to a cross sectional area of the core component, the fineness, the strength at break and the elongation at break are each adjusted within specified ranges, the shrinkage in hot water at 100° C. is within a specified range, and the fiber surface coverage of the sheath component is 85% or more. This results in provision of an electrically conductive sheath-core conjugate fiber that is excellent in antistatic performance, which is hardly degraded even after long-term wearing, that is maintained for a long time, and that is excellent in durability. A method for producing the electrically conductive sheath-core conjugate fiber and a dust-proof clothing using such a fiber are also provided.

9 Claims, 2 Drawing Sheets

CONDUCTIVE SHEATH-CORE CONJUGATE FIBER AND PROCESS FOR PRODUCING THE SAME

TECHNICAL FIELD

The present invention relates to an electrically conductive sheath-core conjugate fiber having excellent antistatic performance, especially an electrically conductive sheath-core conjugate fiber which has excellent antistatic performance in practical wearing durability as well as excellent fiber properties, and preferably has excellent acid resistance. More particularly, the present invention relates to an electrically conductive sheath-core conjugate fiber including an electrically conductive layer made of a thermoplastic polymer (A) containing a specified amount of electrically conductive carbon black fine particles which constitutes a sheath component and a protective layer made of a fiber-forming thermoplastic polymer (B) which constitutes a core component. The electrically conductive sheath-core conjugate fiber has excellent antistatic performance, which is not degraded very much over practical wearing for a long term, though it contains only a relatively small amount of electrically conductive carbon black fine particles, and the fiber is suitable for the field of clothing such as clean room wears and working wears.

BACKGROUND ART

Various proposals about electrically conductive fibers have heretofore been made. For example, known is an electrically conductive fiber having electrical conductivity imparted by plating metal onto the surface of a fiber having no electrical conductivity. However, there is a problem with such an electrically conductive fiber having a metal plating layer on its surface that electrically conducting performance is degraded because the plating layer on the surface readily exfoliates during a knitting/weaving process or its following process or the plating layer is readily dissolved and removed during a dyeing treatment or a refining treatment of textile.

A metal fiber is known as another type of electrically conductive fiber. It, however, has problems that metal fiber is generally high in cost and poor in spinnability; it causes troubles during the knitting/weaving process or dye-finishing process; it readily breaks or exfoliates in washing on practical use; and it readily gathers rust.

In place of such known technologies using metal, an electrically conductive conjugate fiber is known which is obtained by adding electrically conductive carbon black fine particles to a thermoplastic polymer, causing a resulting material to exist in the form of an electrically conductive layer on the surface of or inside a fiber continuously along the longitudinal direction of the fiber, and conjugate spinning the resultant with another fiber-forming thermoplastic polymer. However, in order to obtain electrically conducting performance by the thermoplastic polymer to which electrically conductive carbon black fine particles have been added (hereinafter, referred to as an electrically conductive layer), it is necessary to add a large amount of electrically conductive carbon black fine particles to the polymer. Addition of a large amount of carbon black fine particles causes a problem in which the spinnability and the stretchability of the polymer deteriorate drastically. As a method of solving problems caused by stretching, a method including no stretching is conceivable. However, when stretching is not performed, the fiber itself has low strength and the carbon black fine particles in the electrically conductive layer fail to form the structure described below, and therefore no satisfactory electrically conducting performance will be obtained. Moreover, such a method has a drawback that if the stretching is performed by force, the electrically conductive layer will be broken in the fiber or, even if it is not broken, the structure of the electrically conductive carbon black fine particles will be broken. Further, the electrically conductive layer will be broken readily when a slight external force is applied to the electrically conductive fiber, and as a result the electrically conducting performance will be lost.

There is another problem that an electrically conductive layer containing a large amount of carbon black fine particles shows low adhesiveness to another polymer forming the fiber and, as a result, interfacial peeling will occur readily during a process for producing woven/knitted fabrics or during use as an electrically conductive product to change the electrically conductive layer to a sole fiber and an electrically conductive layer with a low strength-elongation will be broken easily (see, for example, JP-A 57-29611 and JP-A 58-132119).

The problems with the above-described conventional electrically conductive fibers include that the strength of fiber itself is low, that an electrically conductive layer is readily broken, that no satisfactory electrically conducting performance is obtained, that an electrically conductive layer readily exfoliates, and that the conventional electrically conductive fibers are inferior in acid resistance and durability.

The present inventors have already filed on Jan. 11, 2006 a patent application (Japanese Patent Application No. 2006-003567) as an electrically conductive fiber which solves these problems. The invention relates to a fiber containing a polyethylene terephthalate as a major component. This is an item in which the fiber surface is substantially entirely covered with a polyester-based electrically conductive layer composed of the fiber's surface layer incorporated with carbon black fine particles. Moreover, the proportion of the electrically conductive layer in the fiber is adjusted within a range of 15% by weight or more. By obtaining such an electrically conductive fiber by a special spinning method, it is possible to obtain a fiber excellent in strength and elongation degree and to inhibit an electrically conductive layer from breaking. Furthermore, by using a polyethylene terephthalate-based resin as a fiber-constituting resin, it is possible to obtain a sheath-core conjugate fiber excellent in acid resistance and durability.

However, the present inventors found that the prior application can achieve fiber performance and electrically conducting performance which are greatly improved than conventional fibers, but it is not insufficient for fields where higher performance is required. They researched in order to find an electrically conductive fiber which highly satisfies required performance, achieving the present invention. That is, the present invention restricts the cross sectional shape of a fiber to a specified shape in the aforementioned already-filed invention. This can achieve initial performance and its durability at a higher level and it provides an effect superior to that of the invention of the prior application also in applications where higher performance is required.

DISCLOSURE OF THE INVENTION

Problems to be Solved by the Invention

An object of the present invention is to provide an electrically conductive conjugate fiber that has excellent antistatic performance, which is maintained for a long period of time with almost no degradation even over a continuous use for a long term, and that is also excellent in acid resistance when the constitutional resin is chosen, which has not been achieved in conventional electrically conductive sheath-core conjugate fibers, to provide a method for producing the same, and to provide a dust-proof clothing using such a fiber.

Means for Solving the Problem

The present invention is directed to an electrically conductive sheath-core conjugate fiber including an electrically conductive layer made of a thermoplastic polymer (A) containing electrically conductive carbon black fine particles which constitutes a sheath component and a protective layer made of a fiber-forming thermoplastic polymer (B) which constitutes a core component, wherein the conjugate fiber satisfies the following conditions (a) through (g):

sheath component(electrically conductive layer)/core (protective layer)[weight ratio]=10/90 to 35/65 (a)

$1.04 \leqq L_1/L_0 \leqq 10.0$ (b)

$1.5 \leqq$ fineness(dtex) $\leqq 20$ (c)

$1.8 \leqq$ strength at break(cN/dtex) $\leqq 4.5$ (d)

$50 \leqq$ elongation at break(%) $\leqq 90$ (e)

shrinkage in hot water at 100° C. $\leqq 20\%$ (f)

fiber surface coverage of sheath component $\geqq 85\%$ (g)

wherein $L_1$ represents the length of a boundary between the core component and the sheath component in a cross section of the conjugate fiber and $L_0$ represents the length of the circumference of a circle having an area equal to the cross sectional area of the core component.

It is preferable that the electrically conductive layer has, in a cross section of the fiber, 2 to 4 or 10 to 50 projections projecting toward the center of the fiber. It is also preferable that the thermoplastic polymer (A) constituting the electrically conductive layer is a polyester-based polymer having a melting point of 200° C. or higher, the thermoplastic polymer (B) constituting the protective layer is a polyester-based polymer having a melting point of 210° C. or higher, and the difference between the SP values $[(cal/cm^3)^{1/2}]$ of the polyester-based polymer constituting the electrically conductive layer and the polyester-based polymer constituting the protective layer is 1.1 or less. It is particularly preferable that the thermoplastic polymer (A) constituting the electrically conductive layer is a polybutylene terephthalate-based polyester and the thermoplastic polymer (B) constituting the protective layer is a polyethylene terephthalate-based polyester, and the thermoplastic polymer (A) constituting the electrically conductive layer is a Nylon-6 polyamide and the thermoplastic polymer (B) constituting the protective layer is a Nylon-66 polyamide.

A preferable embodiment is a multifilament including a bundle of from 3 to 10 fibers each being the above-described electrically conductive sheath-core conjugate fiber, wherein the multifilament has a total fineness of from 10 to 40 dtex. Another preferable embodiment is a dust-proof clothing made of a woven fabric in which the above-described electrically conductive sheath-core conjugate fiber is used as a part of warps or wefts, wherein the electrically conductive sheath-core conjugate fiber is arranged at intervals along the longitudinal or latitudinal direction of the woven fabric.

The present invention is directed also to a method for producing an electrically conductive sheath-core conjugate fiber including an electrically conductive layer made of a thermoplastic polymer (A) containing electrically conductive carbon black fine particles which constitutes a sheath component and a protective layer made of a fiber-forming thermoplastic polymer (B) which constitutes a core component, wherein the ratio of the (A) to the total weight of the (A) and the (B) is 10 to 35% by weight, the $L_1/L_0$ ratio is 1.04 to 10.0 where $L_1$ represents the length of a boundary between the core component and the sheath component in a cross section of the conjugate fiber and $L_0$ represents the length of the circumference of a circle having an area equal to a cross sectional area of the core component, and the fiber surface coverage of the sheath component is 85% or more, wherein operations of (1) through (5) defined below are carried out in this order so that (6) given below can be satisfied:

(1) merging a molten polymer liquid of the (A) and a molten polymer liquid of the (B), followed by melt-discharging through a conjugate spinneret, (2) cooling the discharged molten polymer flow temporarily to a temperature lower than a glass transition point, (3) subsequently transferring it through a heating device to subject it to heat-stretching treatment, (4) thereafter providing oil to it, (5) winding it at a rate of 3000 m/min or more, (6) the operations (1) through (3) are carried out before the discharged polymer flow and a thread formed through solidification of the discharged polymer flow come into contact with a roller or a guide at first.

Effect of the Invention

As described above, the electrically conductive sheath-core conjugate fiber of the present invention has excellent antistatic performance which is maintained for a long period of time with almost no degradation even over continuous use for a long term and is further excellent in acid resistance, which has not been achieved in conventional electrically conductive conjugate fibers. Therefore, it can be used in the field of dust-proof clothing, in which the conventional electrically conductive conjugate fibers have not been able to be used. Moreover, it can be used as fibers of working wears in other fields where prevention of antistatic electricity generation is required, antistatic brushes of copying machines, or the like.

DESCRIPTION OF REFERENCE SYMBOLS

A: Electrically conductive layer

Figure 1:
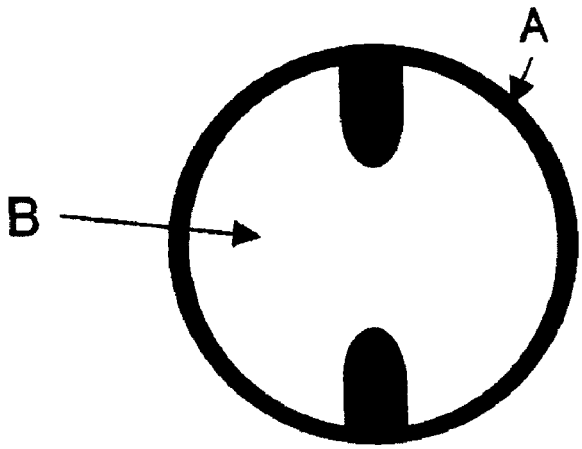
FIG. 1 is a cross sectional view of the electrically conductive sheath-core conjugate fibers of Examples 1 to 4 and 8.

B: Protective layer x: Length of projection y: Width of projection

R: Diameter (outer diameter) of fiber

BEST MODE FOR CARRYING OUT THE INVENTION

First, in the present invention, an electrically conductive sheath-core conjugate fiber is composed of an electrically conductive layer made of a thermoplastic polymer (A) containing electrically conductive carbon black fine particles (hereinafter, sometimes referred to as an electrically conductive layer (A) or an electrically conductive polymer layer (A)) and a protective layer made of a fiber-forming thermoplastic polymer (B) containing substantially no electrically conductive carbon black fine particles (hereinafter, sometimes referred to as a protective layer (B) or a protective polymer layer (B)), wherein the electrically conductive layer (A) forms a sheath component and the protective layer (B) forms a core component.

In the present invention, a preferable content of the electrically conductive carbon black fine particles contained in the electrically conductive layer (A) is from 20 to 40% by weight, more preferably from 25 to 38% by weight, and even more preferably from 25 to 35% by weight. If the content of electrically conductive carbon black fine particles is less than 20% by weight, an electrical conductivity that is intended by the present invention can not be obtained and sufficient antistatic performance is not developed. On the other hand, if the content is more than 40% by weight, further improvement in electrical conductivity is not recognized and rather the fluidity of the electrically conductive carbon black fine particle-containing polymer is rapidly lowered greatly and the spinnability (fiber forming property) is extremely deteriorated.

The electrically conductive carbon black fine particles used in the present invention preferably have an intrinsic electrical resistance of from $10^{-3}$ to $10^{3}$ Ω·cm. When carbon black fine particles are completely dispersed as particulates, the electrical conductivity is generally insufficient, whereas when they form a chain structure called "structure", the electrically conducting performance is improved and they are called "electrically conductive carbon black fine particles." In imparting electric conductivity to a polymer by use of electrically conductive carbon black fine particles, it is important to disperse the carbon black fine particles in the polymer without breaking the structure.

In general, when normal stretching is performed, the structure is broken readily. The present invention, however, is characterized in that almost no structure has been broken though stretching has been performed because a special stretching method described below is used. Since the conventional common stretching methods are methods in which stretching is performed by force utilizing a difference in speed between rollers, fibers will be stretched by force and the structure will be broken. In the case of not a method in which the stretching is performed between rollers but a method in which a fiber is subjected to free stretching like the present invention, the structure becomes less prone to break because no excessive tensile force is applied to the fiber.

Conceivable mechanisms of the electrical conduction of an electrically conductive carbon black fine particle-containing composite include contact of carbon black chains and the tunnel effect. However, the former is believed to be major. Therefore, the longer the chain of carbon black fine particles and the more densely the carbon black fine particles exist in a polymer, the greater the contact probability is and the higher the electric conductivity is. When a polymer forming an electrically conductive layer (A) is crystallized moderately and a loose structure in which amorphous portions can undergo molecular motion is formed in order to lengthen the chain, carbon black fine particles gather in the amorphous portions and the carbon concentration in the amorphous portions increases. As a result, the electrically conducting performance is enhanced.

In the present invention, since a special spinning stretching method described below is used, the electrically conductive layer is more crystallized and the amorphous portions are in a state where they can undergo molecular motion more in comparison to electrically conductive conjugate fibers having been subjected to normal stretching treatment. Therefore, the fiber of the present invention is excellent as an electrically conductive conjugate fiber. The electrically conductive conjugate sheath-core fiber of the present invention obtained by a special spinning stretching method satisfies the following formulas (d), (e) and (f) with respect to the strength at break (DT), the elongation at break (DE) and the shrinkage in hot water at 100° C. contrary to electrically conductive fibers obtained by the conventional common stretching methods including the spinning-direct-stretching process or unstretched electrically conductive fibers:

$$1.8 \leqq \text{strength at break(cN/dtex)} \leqq 4.5 \quad \text{(d)}$$

$$50 \leqq \text{elongation at break(\%)} \leqq 90 \quad \text{(e)}$$

$$\text{shrinkage in hot water at } 100^\circ\text{ C.} \leqq 20\% \quad \text{(f).}$$

While use of a spinning/stretching method described below can result in satisfaction of the strength at break, the elongation at break, and the shrinkage in hot water provided in the present invention, there is a general tendency that increase in the winding rate can result in increase in the strength at break and that reduction in the winding rate can result in increase in the elongation at break. Furthermore, increase in the temperature of a heating zone can result in decrease in the shrinkage in hot water.

According to the investigation results obtained by the inventors, if the polymer to which electrically conductive carbon black fine particles is added is a polyester-based polymer, when the content of electrically conductive carbon black fine particles is less than 20% by weight, almost no effect is obtained. When the content becomes 23% by weight, the electrical conductivity is improved rapidly. When the content is more than 25% by weight, the electrical conductivity will be almost saturated.

Electrically conductive fibers are typically used for working wears, dust-proof clothing, and the like in places where explosion may occur due to generation of static electricity. In the course of use for a long period of time, severe bending, stretching, folding, friction, and the like are repeated and washing is also repeated. As a result, the performance of an electrically conductive layer portion in electrically conductive fibers is necessarily degraded gradually and, therefore, the antistatic performance as clothing has to be degraded. Once the electrically conductive layer is broken due to strain such as cracking and the continuity thereof is lost, it is difficult to be repaired. As a result, it is difficult to wear it continuously for a long period of time and, at present, working wears or dust-proof clothing has to be renewed in a certain period of time. Use of the electrically conductive sheath-core conjugate fiber of the present invention causes almost no deterioration in performance in comparison to working wears or dust-proof clothing using the conventional electrically conductive fibers. Therefore, it enables clothing to be worn for a long time.

In the present invention, the thermoplastic polymer which constitutes the electrically conductive layer (A) satisfying the above-described required performance includes polyester-based resins and polyamide-based resins. Examples of such polyester-based resins include fiber-forming polyesters produced by using a dicarboxylic acid component, such as aromatic dicarboxylic acids, e.g., terephthalic acid, isophthalic acid, naphthalene-2,6-dicarboxylic acid, 4,4'-dicarboxydiphenyl and 5-sodium sulfoisophthalic acid and aliphatic dicarboxylic acids, e.g., azelaic acid and sebacic acid, and a diol component, such as aliphatic diols, e.g., ethylene glycol, diethylene glycol, propylene glycol, 1,4-butanediol, polyethylene glycol and polytetramethylene glycol, aromatic diols, e.g., ethylene oxide adducts of bisphenol A or bisphenol S, and alicyclic diols, e.g., cyclohexane dimethanol. In particular, polyesters having 80 mol % or more, especially 90 mol % or more of ethylene terephthalate units or butylene terephthalate units, which are general purpose polyesters, are preferred.

In particular, polybutylene terephthalate-based resins, namely, polyester-based resins having 80 mol % or more of butylene terephthalate units are preferred because electrically conductive carbon black fine particles can be easily kneaded thereinto and they readily crystallize, and therefore high electrically conducting performance can be obtained. Polyethylene terephthalate-based resins also can be used. However, addition of a large amount of electrically conductive carbon black fine particles will result in deterioration of spinnability at the time of melt-spinning. Therefore, it is conceivable to use a copolymerized polyethylene terephthalate in order to enhance the spinnability. However, use of a copolymerized polyethylene terephthalate generally causes deterioration of crystallinity, which will result in degradation of electrically conducting performance. According to the facts mentioned above, polybutylene terephthalate-based resins, which are polyester-based resins which readily form crystals, are particularly excellent. From the viewpoint of practical durability, it is preferable that the melting point of the resin forming the electrically conductive layer (A) is 200° C. or higher. Resins, especially polyester-based resins, having a melting point of from 210° C. to 250° C. are more preferred.

Any polymers having an amide linkage (—CO—NH—) in the main chain thereof can be used as the above-described polyamide-based polymers without any limitations. Examples of such polymers include aliphatic polyamides such as 4,6-Nylon, 6-Nylon, 6,6-Nylon, 6,10-Nylon, 6,12-Nylon, 11-Nylon and 12-Nylon; aromatic polyamides such as Nylon MXD6 (a commercial product available under the name "MX Nylon" from Mitsubishi Gas Chemical Co., Inc.) and a commercial product available under the name "ARLEN" from Mitsui Chemicals, Inc. Preferred are 6-Nylon, 6,6-Nylon, 6,12-Nylon and 12-Nylon. Among these, 6,6-Nylon and 12-Nylon are more preferable because they exhibit only a small change in dimension or property caused by water absorption and are excellent in stability at the time of winding on spinning. These may be used alone or in combination of two or more.

Furthermore, a thermoplastic semiaromatic polyamide can be used which is composed of a dicarboxylic acid component and a diamine component, wherein 60 mol % or more of the dicarboxylic acid component is an aromatic dicarboxylic acid and 60 mol % or more of the diamine component is an aliphatic alkylene diamine having 6 to 12 carbon atoms. From the viewpoint of heat resistance, terephthalic acid is preferable as such an aromatic dicarboxylic acid. This may be used together with one or two or more aromatic dicarboxylic acids such as isophthalic acid, 2,6-naphthalenedicarboxylic acid, 2,7-naphthalenedicarboxylic acid, 1,4-naphthalenedicarboxylic acid, 1,4-phenylenedioxydiacetic acid, 1,3-phenylenedioxydiacetic acid, diphenic acid, dibenzoic acid, 4,4'-oxydibenzoic acid, diphenylmethane-4,4'-dicarboxylic acid, diphenylsulfone-4,4'-dicarboxylic acid and 4,4'-biphenyldicarboxylic acid. The content of such an aromatic dicarboxylic acid is preferably 60 mol % or more, and more preferably 75 mol % or more of the dicarboxylic acid component.

Examples of dicarboxylic acids other than the above-described aromatic dicarboxylic acids include aliphatic dicarboxylic acid such as malonic acid, dimethylmalonic acid, succinic acid, 3,3-diethylsuccinic acid, glutaric acid, 2,2-dimethylglutaric acid, adipic acid, 2-methyladipic acid, trimethyladipic acid, pimelic acid, azelaic acid, sebacic acid and suberic acid; and alicyclic dicarboxylic acids such as 1,3-cyclopentane dicarboxylic acid and 1,4-cyclohexane dicarboxylic acid. These acids may be used not only alone and also in combination of two or more. Furthermore, polycarboxylic acids such as trimellitic acid, trimesic acid and pyromellitic acid may be contained in the condition in which a fiber can be produced easily. In the present invention, it is preferable, from the viewpoint of fiber property, heat resistance and the like, that the dicarboxylic acid component is composed 1000 of aromatic dicarboxylic acid.

It is preferable that 60 mol % or more of the diamine component is composed of an aliphatic alkylenediamine having 6 to 12 carbon atoms. Examples of such an aliphatic alkylenediamine include 1,6-hexanediamine, 1,8-octanediamine, 1,9-nonanediamine, 1,10-decanediamine, 1,11-undecanediamine, 1,12-dodecanediamine, 2-methyl-1,5-pentanediamine, 3-methyl-1,5-pentanediamine, 2,2,4-trimethyl-1,6-hexanediamine, 2,4,4-trimethyl-1,6-hexanediamine, 2-methyl-1,8-octanediamine and 5-methyl-1,9-nonanediamine. In particular, from the viewpoint of fiber property and heat resistance, it is preferable to use 1,9-nonanediamine alone or to use 1,9-nonanediamine and 2-methyl-1,8-octanediamine in combination. The content of the aliphatic alkylenediamine is preferably 60 mol % or more, more preferably 75 mol % or more, and particularly preferably 90 mol % or more of the diamine component.

Examples of diamines other than the above-described aliphatic alkylenediamines include aliphatic diamines such as ethylenediamine, propylenediamine and 1,4-butanediamine; alicyclic diamines such as cyclohexanediamine, methylcyclohexanediamine, isophoronediamine, norbornane dimethyldiamine and tricyclo decanedimethyldiamine; aromatic diamines such as p-phenylenediamine, m-phenylenediamine, xylylenediamine, 4,4'-diaminodiphenylmethane, 4,4'-diaminodiphenyl sulfone and 4,4'-diaminodiphenyl ether, and mixtures thereof. These may be used not only alone and also in combination of two or more.

When 1,9-nonanediamine and 2-methyl-1,8-octanediamine are used in combination as the aliphatic alkylenediamine, it is preferable, from the viewpoint of spinnability of fibers and fiber property, that from 60 to 100 mol % of the diamine component is composed of 1,9-nonanediamine and 2-methyl-1,8-octanediamine and simultaneously that the molar ratio of the former to the latter is from 30:70 to 99:1, and particularly is from 40:60 to 95:5.

A resin containing electrically conductive carbon black fine particles kneaded therein in a high concentration is difficult to be processed solely into fiber because it is insufficient in spinnability and stretchability even if the resin serving as a matrix has a sufficient fiber-forming property. Therefore, the fiberizing processability and fiber properties are maintained by conjugating the electrically conductive layer polymer (A) and the protective layer polymer (B).

In the electrically conductive sheath-core conjugate fiber of the present invention, the weight ratio of the electrically conductive layer (A) to the protective layer (B) (electrically conductive layer/protective layer) is from 10/90 to 35/65.

When the electrically conductive layer (A) of the sheath component containing carbon black fine particles accounts for more than 35% by weight of the weight of the fiber, the spinnability at the time of spinning tends to be impaired and breakage of fiber during spinning or stretching often occurs. For this reason, the proportion of the electrically conductive layer (A) is preferably 25% by weight or less. On the other hand, the protective layer (B) of the core component has to account for 65% by weight or more of the weight of the fiber. The proportion of the protective layer (B) is preferably 70% by weight or more. However, the proportion of the electrically conductive layer (A) has to be 10% by weight or more and it is preferably 15% by weight or more because when the amount of the electrically conductive layer is extremely small, problems about continuity of the electrically conductive layer will arise.

The protective layer (B) takes an important role in the maintenance of good processability during the fiberization of the present invention and the maintenance of long period durability by preventing occurrence of interfacial peeling from the electrically conductive layer (A). It is important to use a fiber-forming thermoplastic polymer as the polymer forming the protective layer (B). In particular, from the viewpoint of durability, a thermoplastic crystalline polymer having a melting point of 210° C. or higher is used as the polymer for forming the protective layer (B) of the present invention. Basically, polymers poor in spinnability are not suitable as resins for forming the protective layer of the present invention.

Examples of the thermoplastic polymer forming the protective layer (B) include fiber-forming polyesters produced by using a dicarboxylic acid component, such as aromatic dicarboxylic acids, e.g., terephthalic acid, isophthalic acid, naphthalene-2,6-dicarboxylic acid, 4,4'-dicarboxydiphenyl and 5-sodium sulfoisophthalic acid and aliphatic dicarboxylic acids, e.g., azelaic acid and sebacic acid, and a diol component, such as aliphatic diols, e.g., ethylene glycol, diethylene glycol, propylene glycol, 1,4-butanediol, polyethylene glycol and polytetramethylene glycol, aromatic diols, e.g., ethylene oxide adducts of bisphenol A or bisphenol S, and alicyclic diols, e.g., cyclohexane dimethanol.

In particular, polyesters having 80 mol % or more, especially 90 mol % or more of ethylene terephthalate units or butylene terephthalate units, which are general purpose polyesters, are mentioned. Modified polyesters containing a small amount of third component can be used as well. Moreover, such polymers may contain a small amount of additives, fluorescent whitening agents, stabilizers, and the like. Such polyesters have good melt viscosity properties at the time of being fiberized to obtain more excellent fibers in fiber properties and heat resistance. From the viewpoint of fiberizing processability, fiber properties and durability, polyethylene terephthalate-based polyesters are preferred. In particular, polyesters having a melting point of from 240° C. to 280° C. are preferred. Polyester-based polymers having a melting point higher than that of the polyester-based polymer or polyamide-based polymer forming the electrically conductive layer (A) by from 10 to 50° C. are preferable as the polymer for the protective layer. Therefore, it is preferable to use a polybutylene terephthalate-based polyester as the thermoplastic polymer forming the electrically conductive layer (A) and to use a polyethylene terephthalate-based polyester as the polymer forming the protective layer (B).

The polyamide-based resin includes aliphatic polyamides such as 4,6-Nylon, 6-Nylon, 6,6-Nylon, 6,10-Nylon, 6,12-Nylon, 11-Nylon and 12-Nylon and aromatic polyamides. Preferred are 6-Nylon, 6,6-Nylon, 6,12-Nylon and 12-Nylon. A preferable combination of polymers in the case of using a polyamide-based resin is a combination of a 6-Nylon-based polyamide as the thermoplastic polymer forming the electrically conductive layer (A) and a 6,6-Nylon-based polyamide as the polymer forming the protective layer (B). In this case, an electrically conductive sheath-core conjugate fiber excellent in both fiber property and electrically conducting performance can be obtained.

In the present invention, it is preferable to use a combination in which the SP value (solubility parameter) ($\phi 1$) of the fiber-forming polymer forming the protective layer (B) and the SP value ($\phi 2$) of the thermoplastic polymer forming the electrically conductive layer (A) satisfy formula (h) given below. A combination of polymers satisfying this condition is so good in adhesiveness between the polymers that interfacial peeling hardly occurs and also is advantageous in fiber property. In the case of $|\phi 1-\phi 2|>1.1$, interfacial peeling tends to occur and durability in practical use is hardly obtained.

$$0 \leqq |\phi 1-\phi 2| \leqq 1.1 \quad \text{(h)}$$

In the above formula, $\phi 1$ means the SP value $[(\text{cal/cm}^3)^{1/2}]$ of the fiber-forming polymer forming the protective layer (B) and $\phi 2$ means the SP value $[(\text{cal/cm}^3)^{1/2}]$ of the thermoplastic polymer forming the electrically conductive layer (A).

In a case, as mentioned above, where a polybutylene terephthalate-based polyester is used as the thermoplastic polymer forming the electrically conductive layer (A) and a polyethylene terephthalate-based polyester is used as the polymer forming the protective layer (B), the above-described SP value difference is satisfied. Quite an excellent result can be obtained in the present invention also in a case where a 6-Nylon-based polyamide is used as the thermoplastic polymer forming the electrically conductive layer (A) and a 66-Nylon-based polyamide is used as the polymer forming the protective layer (B), and the SP value difference is satisfied also in this case. More preferable is a case where the SP value difference is 0.8 or less.

Next, the cross sectional shape of an electrically conductive sheath-core conjugate fiber (a cross section perpendicular to the fiber axis direction), which is an important factor in the present invention, is described in detail. The cross sectional shape of the electrically conductive sheath-core conjugate fiber of the present invention is a cross sectional shape in which the protective layer (B) occupies the inside of the fiber and the electrically conductive layer (A) covers the surface of the protective layer (B) so that 85 to 100% of the fiber surface, or preferably substantially all (namely, 100%) of the fiber surface will be covered and it is required to satisfy the following formula (b).

$$1.04 \leqq L_1/L_0 \leqq 10.0 \quad \text{(b)}$$

In the above formula, $L_1$ represents the length of a boundary between the core component and the sheath component in a cross section of the conjugate fiber and $L_0$ represents the length of the circumference of a circle having an area equal to a cross sectional area of the core component. While the theoretical explanation why the $L_1/L_0$ ratio is required to be within the range provided in the present invention is still within a inference at present, it is presumed that it is due to increase in the adhesion area of the conjugate components.

When the $L_1/L_0$ is less than 1.04, the fiber will be subjected to repetition of severe bending, stretching, folding, friction, and the like and to repetitive washing due to its short risky elongation (Re) during its use for a long time. As a result, the performance of the electrically conductive layer portion of the electrically conductive layer will necessarily proceed, resulting in deterioration in antistatic performance as clothing. On the other hand, when $L_1/L_0$ is larger than 10.0, it is difficult to form a cross section stably. The $L_1/L_0$ is preferably 1.06 or more, and more preferably 1.1 or more. On the other hand, the $L_1/L_0$ is preferably 7.0 or less, more preferably 5.5 or less, and even more preferably 3 or less. It is important that the following formula (g) is satisfied because the electrically conducting performance will deteriorate if the sheath component (electrically conductive layer) covers less than 85% of the fiber surface:

$$\text{fiber surface coverage of sheath component} \geqq 85\% \quad \text{(g).}$$

The fiber surface coverage of the sheath component is preferably 90% or more, and more preferably 95% or more. The coverage is usually 100% or less.

Figure 2:
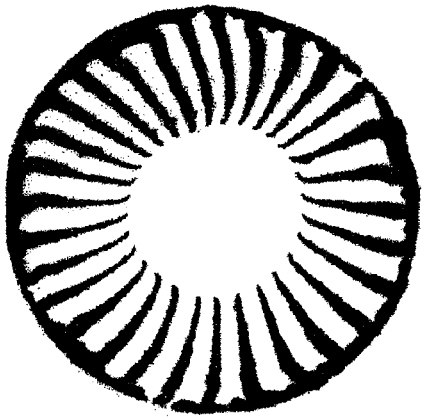
FIG. 2 is a cross sectional view of the electrically conductive sheath-core conjugate fiber of Example 5.

A preferable cross sectional shape of the electrically conductive sheath-core conjugate fiber of the present invention is one in which an electrically conductive layer (a cover layer) has, in a cross section of the fiber, 2 or more projections projecting toward the center of the fiber. In particular, a case where 2 to 4 projections project from the electrically conductive layer at equal intervals is preferred in view of ease with which spinning is performed. The case where there are 2 projections is a case where the projections are present oppositely as symmetrical points with respect to the center of the fiber while projecting from the sheath component layer toward the center of the fiber (shown in FIG. 1). This is a case where extremely excellent results in spinnability and electrically conducting performance can be obtained. A case where there are 10 or more projections is also possible to be produced. For example, the cross sectional shape of FIG. 2 shows a case where there are 30 projections. In this case, the electrically conducting performance, which is typified by resistance, is less prone to be lost in comparison to cases where there are two to four projections as shown in FIG. 1 even if tension is applied to the electrically conductive fiber, whereby the fiber is stretched. In this respect, this product is superior to products having 2 to 4 projections. However, if the number of projections increases too much, it is difficult to perform spinning. For this reason, the number of projections is preferably 50 or less. Therefore, cases where there are 2 to 4 projections are preferable from the viewpoint of resistance, and cases where there are 10 to 50 projections are preferable from the viewpoint of electrically conducting performance to elongation. More preferred are cases of 2 projections and 16 to 40 projections.

In the present invention, with regard to preferable shape of each projection, it is preferable, from the viewpoint of electrically conducting performance and fiber property, that the ratio of the length x of a projection along the direction toward the fiber center and the outer diameter (diameter) R of the fiber (x/R) is within the range of from 0.05 to 0.35. Furthermore, as to the width of a projection (the length y of a projection along a direction perpendicular to the direction toward the fiber center), preferred is a case where considering an average of the projections, a projection has a shape such that the length y is smaller than the length x of the projection and the ratio of the length y of the projection along the direction perpendicular to the direction toward the fiber center and the outer diameter (diameter) R (y/R) is within the range of from 0.02 to 0.2, in other words, the projection has such a shape that the projection extends toward the fiber center. If the ratio (x/R) becomes larger than 0.35, projections come to have such a shape that the protective layer is divided into a plurality of sections by the projections, resulting in decrease in the power as a protective layer which protects the fiber to support properties thereof such as strength at break. Further, when the ratio (x/R) is smaller than 0.05, the effect derived from providing the projection deteriorates. As to the size of a projection, it is preferable, from the viewpoint of ease with which spinning is performed, that a plurality of projections is almost equal in size and almost equal in shape.

The electrically conductive sheath-core conjugate fiber of the present invention is characterized by having a filament electric resistance of from $5\times10^5$ Ω/cm to $5\times10^9$ Ω/cm, and preferably of from $5\times10^5$ Ω/cm to $5\times10^8$ Ω/cm. A case where the electric resistance is less than $5\times10^5$ Ω/cm is undesirable because abnormal discharge will occur. A case where the electric resistance is more than $5\times10^9$ Ω/cm is also undesirable because electrically conducting performance will fail to be exhibited.

The filament electric resistance of the electrically conductive sheath-core conjugate fiber of the present invention is determined depending mainly on the amount of electrically conductive carbon black, the stretching ratio, the temperature of a heating zone, the kind of the thermoplastic polymer forming the electrically conductive layer (A), and the like. It is possible to reduce the electric resistance by, for example, reducing the winding rate, increasing the temperature of a heating zone, increasing the added amount of electrically conductive carbon black, or choosing a suitable polymer like those described above as the thermoplastic polymer forming the electrically conductive layer (A).

In the present invention, it is important that an electrically conductive sheath-core conjugate fiber obtained have a monofilament fineness which satisfies the following formula (c):

$$1.5 \leqq \text{fineness(dtex)} \leqq 20 \quad \text{(c).}$$

A case where the monofilament fineness is less than 1.5 dtex is undesirable because the spinning processability is unstable. When the monofilament fineness is more than 20 dtex, durability among fiber properties will fail to be obtained in practical use. The monofilament fineness is preferably within the range of 2.0 to 10 dtex.

In the present invention, it is preferable, from the viewpoint of spinnability of electrically conductive fibers and processability thereof in knitting and weaving, that inorganic fine particles having an average particle diameter of 0.01 to 1 μm other than electrically conductive carbon black are contained at an amount of 0.05 to 10% by weight in the fiber-forming polymer forming the protective layer (B). When the content of the inorganic fine particles is less than 0.05% by weight, the resulting electrically conductive fiber tends to produce loop, fluff, unevenness in fineness, and the like. When the content is more than 10% by weight, the step passability is poor and fiber breakage may be caused. It is more preferable that the inorganic fine particles are contained in a ratio of from 0.2 to 5% by weight.

As the inorganic fine particle contained in the polymer, anyone can be used which has substantially no degrading effect and has excellent stability. Representative examples of such inorganic fine particles include inorganic fine particles of silica, alumina, titanium oxide, calcium carbonate and barium sulfate. These may be used alone or in combination of two or more.

The average particle diameter of the inorganic fine particles is preferably from 0.01 to 1 μm, and more preferably from 0.02 to 0.6 μm. When the average particle diameter is smaller than 0.01 μm, a loop, fluff, unevenness in fineness, or the like occurs in the resulting fiber even when only a slight variation is produced in the tension applied to the line of thread. On the other hand, when the average particle diameter is more than 1 μm, the spinnability and stretchability of a fiber deteriorate and, as a result, fiber breakage in spinning, twining in stretching, and the like are prone to occur. The average particle diameter described herein is a value determined by the centrifugal sedimentation method.

The method of adding inorganic fine particles is not particularly restricted. It is only required that inorganic fine particles are added and mixed so that the particles will be mixed almost uniformly in a polymer at an arbitrary time between the polymerization of the polymer and the time just before melt-spinning.

In the method for producing the electrically conductive conjugate fiber of the present invention used is a melt-spinning machine which is generally used for producing sheath-core conjugate fibers. In order to cause the electrically conductive layer (A) to be exposed in a desired state in the fiber surface, it is preferable to adjust the alignment of the inlet port for the electrically conductive polymer and the inlet port for the protective polymer in a distributing plate in the spinning machine or to adjust the conjugation ratio of the polymers.

Heretofore, electrically conductive conjugate fibers have been produce generally by the following methods.

(i) A method in which an unstretched fiber, which has only been spun, is used directly as an electrically conductive fiber.

(ii) A method in which a fiber is once wound around a bobbin and then it is stretched.

(iii) A method in which discharged fibers are gathered on a first roller and then directly stretched without being wound, which is called "spinning-direct-stretching process."

In the method (i), however, a resulting electrically conductive fiber itself has low strength and satisfactory electrically conducting performance can not be obtained because carbon black fine particles in an electrically conductive layer fail to form the structure. In the methods (ii) and (iii), since an electrically conductive layer is stretched by force in a fiber during a fiber producing process, the electrically conductive layer may be broken or, even if not broken, the structure of electrically conductive carbon black fine particles may be broken. Moreover, the methods (ii) and (iii) have a drawback that even if an electrically conductive layer is not broken during the electrically conductive fiber production, the electrically conductive layer is broken easily when a slight external force is applied to the electrically conductive fiber in the following steps such as a step of manufacturing fabrics and a sewing step, or during wearing of clothing or washing of clothing and, as a result, electrically conducting performance is easily lost.

In order to solve the problems with the above-described conventional method, the present invention uses a special spinning method. That is, the invention is directed to a method for producing an electrically conductive sheath-core conjugate fiber including an electrically conductive layer made of a thermoplastic polymer (A) containing electrically conductive carbon black fine particles which constitutes a sheath component and a protective layer made of a fiber-forming thermoplastic polymer (B) which constitutes a core component, wherein the ratio of the (A) to the total weight of the (A) and the (B) is 10 to 35% by weight, the $L_1/L_0$ ratio is 1.04 to 10.0 where $L_1$ represents the length of a boundary between the core component and the sheath component in a cross section of the conjugate fiber and $L_0$ represents the length of the circumference of a circle having an area equal to a cross sectional area of the core component, and the fiber surface coverage of the sheath component is 85% or more, wherein operations of (1) through (5) defined below are carried out in this order so that (6) given below can be satisfied:

(1) merging a molten polymer liquid of the (A) and a molten polymer liquid of the (B), followed by melt-discharging through a conjugate spinneret, (2) cooling the discharged molten polymer flow temporarily to a temperature lower than a glass transition point, (3) subsequently transferring it through a heating device to subject it to heat-stretching treatment, (4) thereafter providing oil to it, (5) winding it at a rate of 3000 m/min or more, (6) the operations (1) through (3) are carried out before the discharged polymer flow and a thread formed through solidification of the discharged polymer flow come into contact with a roller or a guide at first.

The method of the present invention is characterized in that a conjugate polyester filament melt-discharged is once cooled, and then is subjected to heat stretching treatment using a heating zone such as a tube heater and that the operations from the melt-discharging to the heat stretching (after passing the heating zone) are performed substantially without allowing the filament to come into contact with rollers or guides. By use of such a method, an electrically conductive fiber is not stretched by force between rollers or between a guide and a roller and the stretching ratio of a discharged molten polymer is controlled automatically in a zone within a heating device. As a result, the electrically conductive fiber is not stretched to an extent such that the electrically conductive layer is broken, but the fiber has been stretched. Therefore, the protective layer is stretched sufficiently and the fiber has high fiber properties. In addition, the electrically conductive layer has been stretched and crystallized, and an amorphous portion is in a state where it can undergo molecular motion. As a result, even if tension is applied to the electrically conductive layer, the layer is not broken and is stretchable greatly and, therefore, the electrically conducting performance is not lost. Regarding the heating temperature in the heat stretching, a temperature condition such that both the polymer constituting the electrically conductive layer (A) and the polymer constituting the protective layer (B) are not lower than their glass transition temperatures, but not higher than their melting points is preferred. A fiber is wound at a rate of 3000 m/min or more in the step (5). If winding is conducted at a rate of less than 3000 m/min, the resulting fiber fails to have sufficient durability for practical use and the above-described fiber property is hardly obtained.

In the present invention, it is important that the strength at break (DT) of an electrically conductive sheath-core conjugate fiber obtained by use of the method described above satisfies the following formula (d):

$$1.8 \leqq \text{strength at break(cN/dtex)} \leqq 4.5 \quad \text{(d).}$$

When the strength at break (DT) is less than 1.8 cN/dtex, the fiber is stretched insufficiently and the crystallization of the electrically conductive layer is achieved insufficiently. Therefore, the electrical conductivity is deteriorated. When the strength at break is more than 4.5 cN/dtex, the electrically conductive sheath-core conjugate fiber has been stretched excessively, resulting in failure to obtain durability of electrical conductivity. Such a strength at break can be achieved easily by the special spinning method described above. The strength at break is preferably 2.5 cN/dtex or more, and 4.0 cN/dtex or less. Reducing the winding rate can reduce the strength at break.

In the present invention, it is important that the elongation at break (DE) of an electrically conductive sheath-core conjugate fiber obtained satisfies the following formula (e):

$$\text{elongation at break(\%)} \leqq 90 \quad \text{(e).}$$

When the elongation at break (DE) is less than 50%, this means that the fiber has been stretched excessively and there is a problem that the electrically conductive layer tends to be broken. When the elongation at break is more than 90%, this means that the electrically conductive fiber has not been stretched sufficiently. In this case, satisfactory fiber properties, of course, can not be obtained and electrical conductivity also is not satisfactory. Such an elongation at break also can be achieved easily by the special spinning method described above. The elongation at break is preferably within the range of from 60 to 80%. Increasing the winding rate can reduce the elongation at break.

Furthermore, it is important in the present invention that the shrinkage in hot water at 100° C. of an electrically conductive sheath-core conjugate fiber obtained, i.e., the boiling water shrinkage (Wsr), satisfies the following (f):

$$\text{shrinkage in hot water at } 100^\circ\text{ C.} \leqq 20\% \quad \text{(f).}$$

When the boiling water shrinkage (Wsr) is 20% or less, the dimensional stability is good and the electrically conductive layer is resistant to breakage. The boiling water shrinkage is preferably 15% or less. The boiling water shrinkage is preferably 3% or more because if it is extremely low, the electrically conductive layer will be broken easily in the following steps. Such a boiling water shrinkage can be attained by adjusting the length and the temperature of a heating zone using a spinning method like that described above. That is, when the length or the temperature of the heating zone is increased, the heat-treatment progresses more, resulting in decrease of the boiling water shrinkage.

Then, oil is supplied with an oil supplier to the electrically conductive fiber of the present invention having been spun and stretched in the way described above. It is subsequently subjected, if necessary, to air entangling treatment using an interlacer or the like and then wound at a winding rate of 3000 m/min or more, preferably from 3000 m/min to 4500 m/min via a take up roller. When the winding rate is less than 3000 m/min, the durability for practical use becomes insufficient and it is impossible to obtain desired electrically conductive fibers. From the viewpoint of stretching step-passing ability, the upper limit of the winding rate is preferably 5000 m/min or less. A more preferable winding rate is within the range of from 3500 to 4500 m/min.

It is necessary to provide an oil in the method of the present invention in order to secure the passing ability of following processes. Such an oil to be used may be one composed mainly of a mineral oil and an antistatic agent or the like blended thereto. The amount of the oil to be provided to a fiber surface is within the range of from 0.3 to 2% by weight relative to the weight of the fiber.

Regarding the cooling method in the (2), by adjusting the temperature of the cooling wind to from about 20 to 30° C., the humidity of the cooling wind to from about 20 to 60%, and the blowing rate of the cooling wind to from about 0.4 to 1 m/sec, it is possible to obtain high-quality fibers without causing unevenness in fineness and unevenness in performance. In order to stretching uniformly and smoothly, the length of the heating zone used in the (3) is preferably from 0.6 m to 4 mm, and the temperature of the heating zone is preferably from 150° C. to 220° C. Normally, the heating zone used in the (3) is arranged so that the upper end of the heating zone will be located within a range of from 1 to 2 m below a spinning nozzle.

The electrically conductive sheath-core conjugate fiber of the present invention obtained by such a method has a monofilament fineness of about 1.5 to about 20 dtex. A particularly preferable embodiment is a case where a multifilament is composed of from 3 to 10, preferably from 3 to 6 such electrically conductive sheath-core conjugate fibers bundled, wherein the multifilament has a total fineness of from 10 to 40 dtex. When a multifilament is formed from electrically conductive sheath-core conjugate fibers as mentioned above, even if an electrically conductive layer in one filament is broken, the electrically conducting performance of the entire multifilament is not affected because the electrically conductive layers of the remaining filaments have electrical conductivity. However, when the total fineness or the number of the filaments in a multifilament is small, a sufficient electrical conductivity is not obtained. Conversely, when the total fineness or the number of the filaments in a multifilament is large, arrangement of electrically conductive fibers makes black color noticeable in clothing, affecting the aesthetic property adversely. Therefore, the aforementioned number of fibers and total fineness necessarily are preferred.

The electrically conductive sheath-core conjugate fiber of the present invention may be used in various forms to various applications where antistatic property is required. For example, it can be used in a manner that a yarn is made from an electrically conductive multifilament of the present invention and an electrically non-conductive multifilament in combination so that the electrically conductive multifilament will become a side yarn and the electrically non-conductive multifilament will become a core yarn and the electrically conductive multifilament will be from 1 to 30% longer. As the core yarn, a polyester-based multifilament is preferred. The total thickness of the electrically non-conductive multifilament which serves as a core yarn is preferably within the range of from 20 to 120 dtex. In fabricating into a combined filament yarn, it is common to provide entanglement to a core yarn and a side yarn so that they are not separated. After the provision of such entanglement, the combined filament yarn may be twisted.

It is also permitted that an electrically non-conductive multifilament is used as a core yarn and an electrically conductive multifilament is wound spirally therearound. As the core yarn, one having a thickness the same as that in the case of the aforementioned combined filament yarn is used. Similarly, a polyester-based multifilament is preferable as the core yarn. Such a multifilament yarn including an electrically conductive sheath-core conjugate fiber is arranged at a density of one in every 5 to 50 mm intervals as part of warps and/or wefts in a textile such as woven fabric or knitted fabric. As a result, the textile obtained comes to have antistatic performance.

Such a textile is used in applications where antistatic property is required. For example, it can be used as a dust-proof clothing which is worn in a clean room, or as a antistatic working wear for a worker who works in a site where explosion may be caused by static electricity, like a worker working in a chemical plant or a worker who handles chemicals. Furthermore, the electrically conductive sheath-core conjugate fiber of the present invention can be used as a part of pile of antistatic carpet and as an antistatic brush of a copying machine.

EXAMPLES

The present invention will be described in detail below by way of Examples, by which, however, the invention is not limited at all. Evaluations were carried out by the methods provided below.

[Electrical Resistance]

A DC voltage of from 25 to 500 V was applied to a sample of an electrically conductive fiber (monofilament) which was held between parallel clip electrodes. According to voltmeter ammeter method, the electrical resistance was calculated based on Ohm's law from the voltage and the current which flew in the sample at that voltage. The electrical resistance provided in the present invention is a value determined by applying a voltage of 100 V.

[Shrinkage (Wsr) in Hot Water at 100° C.]

A sample was provided with marks at an interval of 50 cm under an initial load of 1 mg/denier and then was left at rest in a hot water at 98° C. for 30 minutes under a load of 5 mg/denier. Then, it was taken out and the distance L' cm between the marks was measured under a load of 1 mg/denier. The shrinkage was calculated from the following formula.

$$Wsr(\%)=[(50-L')/50]\times 100$$

[Methods for Measuring Strength at Break and Elongation at Break of Fiber]

Measurement was conducted in accordance with JIS L1013 at a fiber length of 10 cm, an elongation rate of 100%/min and normal temperature.

[Method for Durability Evaluation]

After washing a tubular knitted fabric of an electrically conductive fiber 200 times successively, the strength at break and the electric resistance of the electrically conductive fiber were measured.

A: The strength retention rate was 95% or more and the rate of electric resistance change was 1 or less.

B: The strength retention rate was 90% or more and less than 95% and the rate of electric resistance change was from 1 to 2.

C: The strength retention rate was 70% or more and less than 90% and the rate of electric resistance change was from 2 to 3.

D: The strength retention rate was less than 70% and the rate of electric resistance change was 3 or more.

Strength retention rate={(strength at break before treatment−strength at break after treatment)/strength at break before treatment}×100}

Rate of electric resistance change=$|\log(R_1/R_0)|$ $R_0$ is a yarn resistance (Ω/cm·f) at 0 HL (before washing) and $R_1$ is a yarn resistance (Ω/cm·f) after 200 HL (after 200 washings)

[Solubility Parameter: SP Value]

The SP value is a value calculated from ρΣG/M.

G is a cohesive energy constant of an atom or an atomic group.

M is a molecular weight of a structural unit.

[Surface Coverage of Electrically Conductive Layer, Projection Shape, Core-to-Sheath Ratio, Fineness, $L_1/L_0$]

Ten fiber cross sections are chosen arbitrarily from an electron micrograph (×2,000) of fiber cross sections. For the fiber cross sections, average values are determined.

Example 1

Conjugate spinning was performed, at a conjugation ratio (sheath/core) of 18/82 (% by weight) and in a sheath-core cross section such that there were two projections projecting from the sheath component toward the center of the fiber as shown in FIG. 1 and the fiber surface was covered thoroughly with the electrically conductive layer, using a polybutylene terephthalate (PBT, melting point=225° C.) containing 25% by weight of electrically conductive carbon black fine particles as the sheath component for the electrically conductive polymer layer (A) and a polyethylene terephthalate (PET, melting point=255° C.) containing titanium oxide having an average particle diameter of 0.4 μm as the core component for the protective polymer layer (B). Thus was obtained an electrically conductive conjugate multifilament composed of an aggregate of eight sheath-core conjugate filaments, the total fineness of which was 22 dtex. Each of the electrically conductive sheath-core conjugate fibers had a fineness of 2.8 dtex.

Using, as a spinning method, a method including merging a melt of the (A) and a melt of the (B), followed by melt-discharging through a conjugate spinneret, cooling the discharged molten polymer temporarily to a temperature lower than a glass transition temperature, subsequently causing it to run in a heating device, thereby subjecting it to stretching heat treatment, thereafter providing oil to it, and winding it at a rate of 4000 m/min, the stretching heat treatment was performed before the aforementioned discharged thread came into contact with roller or a guide at first. As the cooling method, cooling wind at 25° C. was blown to the fiber just below a nozzle at a rate of 0.4 m/sec. As the method of the heat-stretching treatment, a method in which a heating tube having a diameter of 3 cm and a length of 1 m was arranged 1.4 m just below the nozzle and the inside of the tube was kept at 175° C. was used. The fiberizing processability was good and satisfactory. The evaluation results of the constitution and fiberizing processability of this electrically conductive sheath-core conjugate fiber are summarized in Table 1. This electrically conductive sheath-core conjugate fiber was covered thoroughly with the electrically conductive layer.

In the electrically conductive sheath-core conjugate fiber obtained, the electrically conductive polymer layer (A) continued uniformly along the axial direction of the fiber. The electrical resistance of the conjugate fiber under application of a voltage of from 25 to 500 V was $2.4\times10^7$ Ω/cm·f and it was extremely stable. The conjugate fiber had excellent electrically conducting performance even under a low voltage application. The resulting fiber was fabricated into tubular knitting, the performance of which was as good as at a level of $10^7$ Ω/cm·f even after 200 HL. The results are shown in Table 2.

Subsequently, the resulting electrically conductive conjugate multifilament was wound spirally around a mix-spun yarn of polyester (polyethylene terephthalate)/cotton=65/35 to cover it and then was arranged in warps made of polyester (polyethylene terephthalate)/cotton=65/35 having a cotton count of 20S/2 in a ratio of one in every 80 warps to form a 2/1 twill weave having 80 warps/inch and 50 wefts/inch. Subsequently, the weave was subjected to dyeing and finishing under normal conditions for polyester-cotton mixed fabric.

The surface resistance of the weave was $10^7$ Ω/cm. It had a surface resistance of $10^7$ Ω/cm even after four-month practical wearing, during which washing was repeated 80 times. Thus, it had excellent antistatic performance and the durability of the antistatic performance was also excellent. The results are shown in Table 2. Each of the $\log(R_1/R_0)$ ratios of Examples 1 to 8 in Table 2 is a value calculated by using the value of $\log(R_1/R_0)$ of each Example as a denominator and the value of $\log(R_1/R_0)$ of Comparative Example 1 as a numerator. As this value increases beyond 1, which is the standard value, the performance becomes better.

Examples 2 to 4

Electrically conductive conjugate filaments were prepared by forming a fiber in the same manner as in Example 1 except for using materials shown in Examples 2 to 4 in Table 1 as an electrically conductive polymer layer (A) and a protective polymer layer (B), adjusting the added amounts of carbon black and those of fine particles to the added amounts shown in Examples 2 to 4 in Table 1, and forming a core and a sheath. The fibers obtained were then subjected to performance evaluation. The results of the evaluations of the electrically conductive fibers obtained and the weaves produced therefrom were good. The results are shown in Table 2. Each of the electrically conductive sheath-core conjugate fibers obtained had a monofilament fineness of 2.8 dtex. Ny6 and Ny66 in Table 1 represent 6-Nylon and 6,6-Nylon, respectively.

Examples 5 to 7

Figure 3:
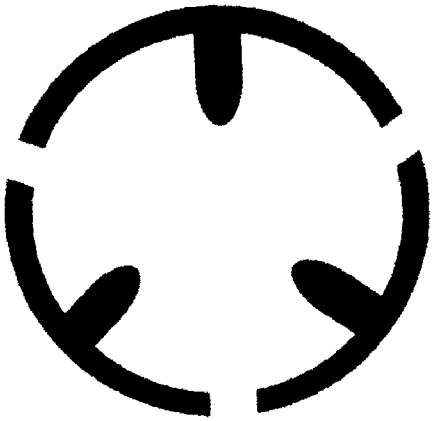
FIG. 3 is a cross sectional view of the electrically conductive sheath-core conjugate fiber of Example 6.
Figure 4:
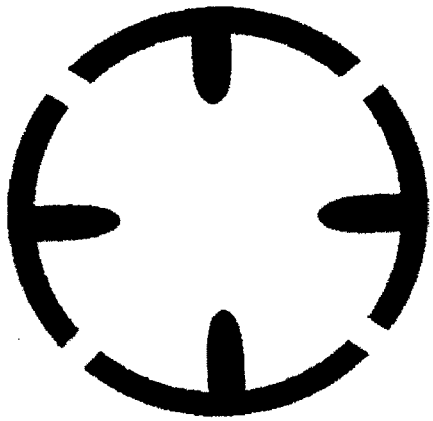
FIG. 4 is a cross sectional view of the electrically conductive sheath-core conjugate fiber of Example 7.

Electrically conductive conjugate filaments were obtained in the same manner as in Example 1, except for using the spinneret components for forming the cross sectional shapes shown in FIG. 2, FIG. 3 and FIG. 4, respectively. In each Example, both the acid resistance and the electrical performance were good. The result of the evaluation is shown in Table 2. In Examples 6 and 7, the fiber surface coverage of the electrically conductive layer (A) was 92%, and the monofilament fineness was 2.8 dtex.

Example 8

In Example 1, a semiaromatic polyamide (PA9MT: the diamine component is a mixture of 1,9-nonanediamine and 2-methyl-1,8-octanediamine at a molar ratio of 1:1; the dicarboxylic acid component is terephthalic acid; the SP value is 11.5) containing 35% by weight of electrically conductive carbon black fine particles was used as the sheath component for the electrically conductive polymer layer (A) and a polyethylene terephthalate containing 0.5% by weight of titanium oxide having an average particle diameter of 0.4 μm as the core component for the protective polymer layer (B). An electrically conductive conjugate multifilament composed of an aggregate of eight sheath-core conjugate filaments, the total fineness of which was 22 dtex, was obtained by performing conjugate spinning at a conjugation ratio (sheath/core) of 18/82 (wt %) and in a sheath-core cross section such that there were two projections projecting from the sheath component toward the center of the fiber as shown in FIG. 1. Each of the electrically conductive sheath-core conjugate fibers had a fineness of 2.8 dtex. The electrically conductive multifilament obtained was processed into a woven fabric in the same manner as in Example 1. The performance of this electrically conductive sheath-core conjugate fiber and the woven fabric are shown in Table 1. This electrically conductive sheath-core conjugate fiber also was covered thoroughly with the electrically conductive layer.

Comparative Example 1

Figure 5:
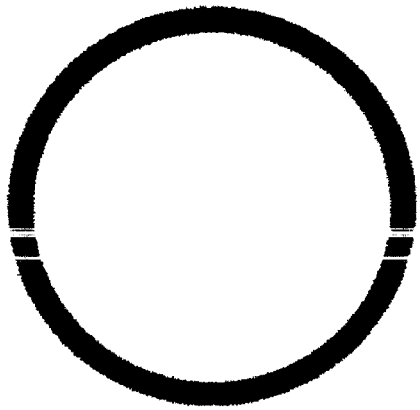
FIG. 5 is a cross sectional view of the electrically conductive sheath-core conjugate fiber of Comparative Example 1.
Figure 6:
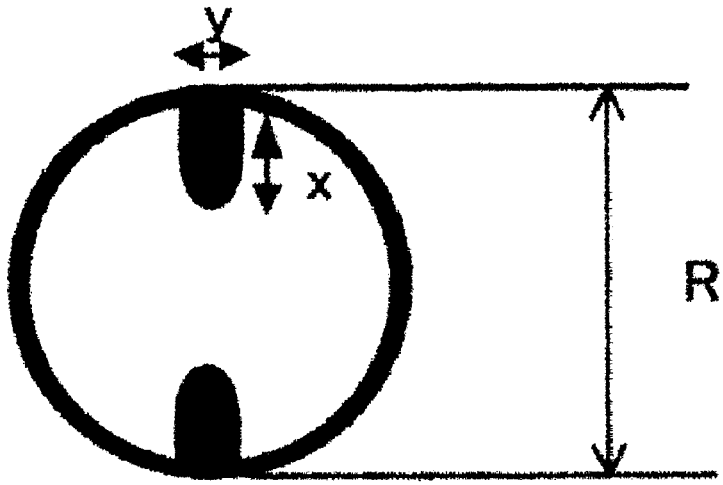
FIG. 6 is a cross sectional view which shows the definitions of the size and dimensions of projections in the electrically conductive sheath-core conjugate fiber of the present invention.

A fiber was produced in the same manner as in Example 1, except for using a spinneret component for causing an electrically conductive layer (A) and a protective polymer layer (B) to form a sheath and a core, respectively, and forming a cross section shown in FIG. 5 (namely, a cross sectional shape having no projections). Then, it was subjected to performance evaluation. As the results of the evaluations, both the resulting electrically conductive fiber and the weave produced therefrom were inferior in performance to the fibers of the present invention. In particular, the product was considerably inferior in durability to the products of the present invention. The results are shown in Table 2. The electrically conductive fiber obtained had a monofilament fineness of 2.8 dtex.

TABLE 1

| | A component polymer | | | B component polymer | | | | | | | | | |
|---|---|---|---|---|---|---|---|---|---|---|---|---|---|
| | Polymer | Added amount of carbon black (wt %) | SP value (φ1) | Kind | Kind of fine particles | Added amount of fine particles (wt %) | SP value (φ2) | Conjugation ratio (A/B) | Cross sectional shape | $L_1/L_0$ | Shape of projection Number | x/R | y/R |
| Example 1 | PBT | 25 | 10 | PET | $TiO_2$ | 0.5 | 10.7 | 18/82 | FIG. 1 | 1.11 | 2 | 0.28 | 0.14 |
| Example 2 | PET | 25 | 10.7 | PET | $SiO_2$ | 3 | 10.7 | 18/82 | FIG. 1 | 1.1 | 2 | 0.26 | 0.14 |
| Example 3 | Ny6 | 35 | 12 | Ny66 | $TiO_2$ | 0.5 | 12.8 | 18/82 | FIG. 1 | 1.08 | 2 | 0.2 | 0.14 |
| Example 4 | Ny6 | 35 | 12 | Ny6 | $TiO_2$ | 0.5 | 12 | 18/82 | FIG. 1 | 1.09 | 2 | 0.21 | 0.16 |
| Example 5 | PBT | 25 | 10 | PET | $TiO_2$ | 0.5 | 10.7 | 18/82 | FIG. 2 | 6.1 | 30 | 0.3 | 0.03 |
| Example 6 | PBT | 25 | 10 | PET | $TiO_2$ | 0.5 | 10.7 | 18/82 | FIG. 3 | 1.23 | 3 | 0.2 | 0.1 |
| Example 7 | PBT | 25 | 10 | PET | $TiO_2$ | 0.5 | 10.7 | 18/82 | FIG. 4 | 1.31 | 4 | 0.17 | 0.09 |
| Example 8 | PA9MT | 35 | 11.5 | PET | $TiO_2$ | 0.5 | 10.7 | 18/82 | FIG. 1 | 1.11 | 2 | 0.28 | 0.14 |
| Comparative Example 1 | PBT | 25 | 10 | PET | $TiO_2$ | 0.5 | 10.7 | 18/82 | FIG. 5 | 1 | 0 | — | — |

TABLE 2

| | Original yarn property | | | | | | Electrical | |
|---|---|---|---|---|---|---|---|---|
| | Resistance (Ω/cm · f) | DT (cN/dtex) | DE (%) | Wsr (%) | log ($R_1/R_0$) ratio | Durability | property of fabric | Overall rating |
| Example 1 | $2.4 \times 10^7$ | 3.1 | 71 | 8.1 | 1.3 | B | B | B |
| Example 2 | $3.6 \times 10^7$ | 3.3 | 68 | 9.4 | 1.2 | B | B | B |
| Example 3 | $4.0 \times 10^6$ | 2.8 | 65 | 10.4 | 1.08 | B | B | B |
| Example 4 | $6.2 \times 10^6$ | 2.4 | 80 | 11 | 1.09 | B | B | B |
| Example 5 | $6.8 \times 10^7$ | 3.4 | 72 | 7.9 | 1.5 | B | B | B |
| Example 6 | $7.8 \times 10^7$ | 3 | 69 | 8 | 1.2 | B | B | B |
| Example 7 | $8.6 \times 10^7$ | 3.1 | 70 | 8.1 | 1.3 | B | B | B |
| Example 8 | $5.0 \times 10^6$ | 3 | 65 | 8 | 1.1 | B | B | B |

TABLE 2-continued

| | Original yarn property | | | | | | Electrical | |
|---|---|---|---|---|---|---|---|---|
| | Resistance (Ω/cm · f) | DT (cN/dtex) | DE (%) | Wsr (%) | log ($R_1/R_0$) ratio | Durability | property of fabric | Overall rating |
| Comparative Example 1 | $2.1 \times 10^7$ | 2.7 | 81 | 9 | 1 | D | B | D |

The invention claimed is:

1. An electrically conductive sheath-core conjugate fiber comprising an electrically conductive layer made of a thermoplastic polymer (A) containing electrically conductive carbon black fine particles which constitutes a sheath component and a protective layer made of a fiber-forming thermoplastic polymer (B) which constitutes a core component, wherein the conjugated fiber satisfies the following conditions (a) through (g):

sheath component(electrically conductive layer)/core component(protective layer)[weight ratio]=10/90 to 35/65 (a)

$1.04 \leqq L_1/L_0 \leqq 10.0$ (b)

1.5≦fineness(dtex)≦20 (c)

1.8≦strength at break(cN/dtex)≦4.5 (d)

50≦elongation at break(%)≦90 (e)

shrinkage in hot water at 100° C.≦20% (f)

fiber surface coverage of sheath component≧85% (g)

wherein $L_1$ represents the length of a boundary between the core component and the sheath component in a cross section of the conjugate fiber and $L_0$ represents the length of the circumference of a circle having an area equal to the cross sectional area of the core component.

2. The electrically conductive sheath-core conjugate fiber according to claim 1, wherein the electrically conductive layer has, in a cross section of the fiber, 2 to 4 projections projecting toward the center of the fiber.

3. The electrically conductive sheath-core conjugate fiber according to claim 1, wherein the electrically conductive layer has, in a cross section of the fiber, 10 to 50 projections projecting toward the center of the fiber.

4. The electrically conductive sheath-core conjugate fiber according to any one of claims 1 to 3, wherein the thermoplastic polymer (A) constituting the electrically conductive layer is a polyester-based polymer having a melting point of 200° C. or higher, the thermoplastic polymer (B) constituting the protective layer is a polyester-based polymer having a melting point of 210° C. or higher, and the difference between the SP values [$(cal/cm^3)^{1/2}$] of the polyester-based polymer constituting the electrically conductive layer and the polyester-based polymer constituting the protective layer is 1.1 or less.

5. The electrically conductive sheath-core conjugate fiber according to claim 4, wherein the thermoplastic polymer (A) constituting the electrically conductive layer is a polybutylene terephthalate-based polyester and the thermoplastic polymer (B) constituting the protective layer is a polyethylene terephthalate-based polyester.

6. The electrically conductive sheath-core conjugate fiber according to any one of claims 1 to 3, wherein the thermoplastic polymer (A) constituting the electrically conductive layer is a Nylon-6 polyamide and the thermoplastic polymer (B) constituting the protective layer is a Nylon-66 polyamide.

7. A multifilament comprising a bundle of from 3 to 10 fibers each being the electrically conductive sheath-core conjugate fiber according to any one of claims 1 to 6, wherein the multifilament has a total fineness of from 10 to 40 dtex.

8. A dust-proof clothing made of a woven fabric in which the electrically conductive sheath-core conjugate fiber according to any one of claims 1 to 6 is used as a part of warps or wefts, wherein the electrically conductive sheath-core conjugate fiber is arranged at intervals along the longitudinal or latitudinal direction of the woven fabric.

9. A method for producing an electrically conductive sheath-core conjugate fiber comprising an electrically conductive layer made of a thermoplastic polymer (A) containing electrically conductive carbon black fine particles which constitutes a sheath component and a protective layer made of a fiber-forming thermoplastic polymer (B) which constitutes a core component, wherein the ratio of the (A) to the total weight of the (A) and the (B) is 10 to 35% by weight, the $L_1/L_0$ ratio is 1.04 to 10.0 where $L_1$ represents the length of a boundary between the core component and the sheath component in a cross section of the conjugate fiber and $L_0$ represents the length of the circumference of a circle having an area equal to a cross sectional area of the core component, and the fiber surface coverage of the sheath component is 85%, or more, wherein operations of (1) through (5) defined below are carried out in this order so that (6) given below can be satisfied:

(1) merging a molten polymer liquid of the (A) and a molten polymer liquid of the (B), followed by melt-discharging through a conjugate spinneret, (2) cooling the discharged molten polymer flow temporarily to a temperature lower than a glass transition point, (3) subsequently transferring it through a heating device to subject it to heat-stretching treatment, (4) thereafter providing oil to it, (5) winding it at a rate of 3000 m/min or more, (6) the operations (1) through (3) are carried out before the discharged polymer flow and a thread formed through solidification of the discharged polymer flow come into contact with a roller or a guide at first.

* * * * *

UNITED STATES PATENT AND TRADEMARK OFFICE

CERTIFICATE OF CORRECTION

PATENT NO. : 7,824,769 B2
APPLICATION NO. : 12/307147
DATED : November 2, 2010
INVENTOR(S) : Hitoshi Nakatsuka et al.

It is certified that error appears in the above-identified patent and that said Letters Patent is hereby corrected as shown below:

Column 21, line 32, "shrinkage in hot water at 100° C. ≦ 20%", should read "shrinkage in hot water at 100°C. ≦ 20% and"

Column 21, line 49, "according to any one of claims 1 to 3, wherein the thermo-", should read "according to claim 1, wherein the thermo-"

Column 22, line 16, "according to any one of claims 1 to 3, wherein the thermo-", should read "according to claim 1, wherein the thermo-"

Column 22, line 22, "jugate fiber according to any one of claims 1 to 6, wherein the", should read "jugate fiber according to claim 1, wherein the"

Column 22, line 26, "according to any one of claims 1 to 6 is used as a part of warps", should read "according to claim 1 is used as a part of warps"

Column 22, line 57, "(6) the operations (1) through (3) are carried out before the", should read "(6) wherein operations (1) through (3) are carried out before the".

Signed and Sealed this
Twenty-ninth Day of March, 2011

David J. Kappos

David J. Kappos
*Director of the United States Patent and Trademark Office*